US007530666B2

(12) United States Patent
Akahira et al.

(10) Patent No.: US 7,530,666 B2
(45) Date of Patent: May 12, 2009

(54) LIQUID DISCHARGE HEAD, LIQUID DISCHARGE RECORDING APPARATUS AND LIQUID DISCHARGE RECORDING METHOD

(75) Inventors: Makoto Akahira, Yokohama (JP); Satoshi Wada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 314 days.

(21) Appl. No.: 11/085,125

(22) Filed: Mar. 22, 2005

(65) Prior Publication Data

US 2005/0212854 A1 Sep. 29, 2005

(30) Foreign Application Priority Data

Mar. 26, 2004 (JP) ..... 2004-092714

(51) Int. Cl.
*B41J 2/135* (2006.01)
*B41J 29/38* (2006.01)
*B41J 2/155* (2006.01)

(52) U.S. Cl. ..... 347/44; 347/13; 347/42

(58) Field of Classification Search ..... 347/5, 347/42, 44, 40, 13
See application file for complete search history.

(56) References Cited

U.S. PATENT DOCUMENTS

| | | | | |
|---|---|---|---|---|
| 4,313,124 | A | 1/1982 | Hara | 346/140 |
| 4,345,262 | A | 8/1982 | Shirato et al. | 346/140 |
| 4,459,600 | A | 7/1984 | Sato et al. | 346/140 |
| 4,463,359 | A | 7/1984 | Ayata et al. | 346/1.1 |
| 4,558,333 | A | 12/1985 | Sugitani et al. | 346/140 |
| 4,723,129 | A | 2/1988 | Endo et al. | 346/1.1 |
| 4,740,796 | A | 4/1988 | Endo et al. | 346/1.1 |
| 4,922,271 | A * | 5/1990 | Nilsson et al. | 347/39 |
| 2002/0024557 | A1 * | 2/2002 | Matsumoto et al. | 347/42 |
| 2005/0212834 | A1 | 9/2005 | Akahira et al. | 347/5 |

FOREIGN PATENT DOCUMENTS

| | | |
|---|---|---|
| JP | 59-123670 | 7/1984 |
| JP | 59-138461 | 8/1984 |

* cited by examiner

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

Groups of discharge ports having plural discharge port rows are arranged in a zigzag shape, and thereby the difference in landing time among the dots which are adjacent to one another in an array direction of the discharge ports while dots overlap one another is kept constant.

1 Claim, 9 Drawing Sheets

LIQUID DISCHARGE HEAD, LIQUID DISCHARGE RECORDING APPARATUS AND LIQUID DISCHARGE RECORDING METHOD

BACKGROUND OF THE INVENTION

1. Field of the Invention

The present invention relates to a liquid discharge head (ink jet head), a liquid discharge recording apparatus (ink jet recording apparatus), and a liquid discharge recording method (ink jet recording method) for performing recording by a liquid discharge recording system (ink jet recording system) in which liquid such as ink is discharged from discharge ports to form pixels on a print material and an image is formed by the pixels.

2. Related Background Art

As a copying machine, information processing equipment such as a word processor and a computer, and communication equipment become widespread, an image forming apparatus for those pieces of the equipment or the image forming apparatus which performs digital image recording as a single recording apparatus using a liquid discharge head rapidly becomes widespread. In the information processing equipment and the communication equipment, as quality of visual information is increased, and as the visual information is colorized, a high-quality image and colorization are also required for the recording apparatus.

In the recording apparatuses, recently the liquid discharge head in which nozzles including discharge ports of liquid such as ink (hereinafter simply referred to as ink) and liquid paths are integrated at high density is used in order to miniaturize an element according to the demand for the high-quality image. In order to perform the color recording, generally the recording apparatus includes ink heads which discharge the colors of the ink corresponding to, e.g., cyan, magenta, yellow, and black ink. Further, while the high-quality image can be formed, high-speed recording action is required for the recording apparatus. Therefore, in order to increase the number of pixels which can be formed at once to achieve the high-speed recording, the liquid discharge head tends to include a large number of nozzles.

Particularly a method, in which a length of the liquid discharge head is substantially set to a maximum width of a recorded print material to enable high-speed output by performing recording in one pass, is being realized. In this case, assuming that the A4 transverse feed page printer is used, the length of the liquid discharge head becomes about 30 cm. Assuming that nozzle density is set to 1,200 dpi (dot per inch), more than 14,000 nozzles are required by rough estimate. A large substrate is required in order to produce the liquid discharge head having such a large number of nozzles at once. Therefore, from the viewpoints of production cost and yield, it is very difficult to produce the liquid discharge head having a large number of nozzles.

Due to a large number of nozzles, it is difficult to produce all the nozzles so that the nozzles exert the same performance, and it is difficult that all the nozzles are maintained at constant performance. Therefore, it is thought that unevenness in ink discharge amount or a shift of landing spot is generated among the nozzles. In order to eliminate unevenness in optical density in the recording image, it is well known that a head shading correction technique is used.

A method of correcting the unevenness in optical density by measuring the optical density of the output image to perform feedback of the measurement result to input image data can generally be cited as an example of the head shading method. When the optical density is decreased because the discharge amount of a certain nozzle is decreased for any reason, evenness in the image optical density is achieved in the output image by performing the correction in which a gray-scale level is increased at a position corresponding to the nozzle.

Further, in a large number of nozzles, there is a possibility that the nozzle does not discharge the ink. In order to perform a complementation process against the problem that the nozzle does not discharge the ink, there is well known a not-discharge nozzle correction (not-discharge complementation) technique in which the image output can be performed even if not all the nozzles have no defect.

Examples of the not-discharge complementation technique include the method in which, when a certain nozzle does not discharge the ink, dots are formed at the positions adjacent to the dot (pixel) instead of the dot to be formed by the nozzle by using the nozzles located on the both sides of the nozzle, the method of performing the correction to the recording action image data so that the dot to be formed by the not-discharge nozzle is included in the surroundings (adjacent complementation), and the method of performing the correction by forming another color ink dot such as black at the position where the dot should be formed by, e.g., the not-discharge nozzle of cyan (different color complementation).

SUMMARY OF THE INVENTION

In the head for the liquid discharge recording system, the difference in landing time among the dots which are adjacent to one another in an array direction of the discharge ports while some of dots overlap one another is kept constant by arranging groups of discharge ports having plural discharge port rows in a zigzag shape, which enables the high-quality, high-speed, high-reliability image output.

DESCRIPTION OF THE PREFERRED EMBODIMENTS

In the liquid discharge recording apparatus, one of technical orientations is how fast the image is output, how much the image is output with high quality, and how much the image is realized at low cost. As described above, however, the long liquid discharge head is effective during forming the high-quality image at high speed, in producing the long liquid discharge head in which the nozzles are integrated at high density, there are problems in that production cost is increased, the yield is decreased, and the performance is difficult to maintain. As described above, in the long liquid discharge head in which the nozzles are integrated at high density, when the head shading technique or the not-discharge complementation technique is used, the image output can be performed even if the defect of a certain level exists. However, the image quality cannot be prevented from decreasing, when compared with the quality of the output image performed by the liquid discharge head with no defect.

In view of the foregoing, an object of the invention is to provide a liquid discharge head, a liquid discharge recording apparatus, and a liquid discharge recording method, which can decrease the unevenness in image density generated by difference in landing time during the formation of the adjacent dots to perform the high-speed, high-quality, high-reliability image output.

Referring now to the accompanying drawings, preferred embodiments of the invention will be described below.

(Liquid Discharge Head)

Figure 1:
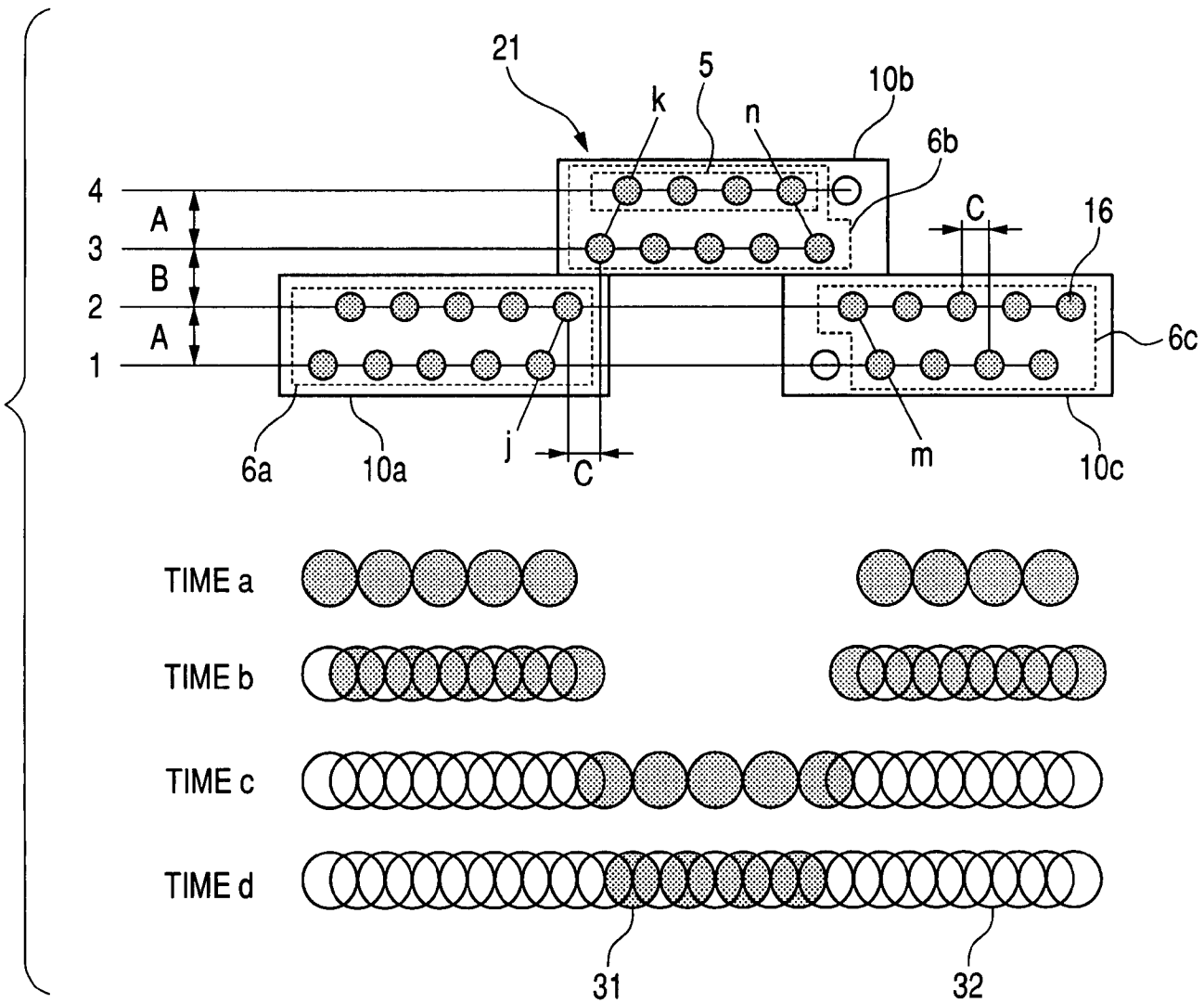
FIG. 1 is a schematic view showing a liquid discharge head according to a first embodiment of the invention when viewed from a discharge port surface side, and FIG. 1 also schematically shows dot patterns formed with the liquid discharge head.

FIG. 1 is a schematic view showing a liquid discharge head (ink jet head) 21 according to a first embodiment of the invention. The liquid discharge head 21 discharges the liquid such as the ink (hereinafter simply referred to as ink). As shown in FIG. 1, the liquid discharge head 21 is formed by arranging plural head chips 10*a*, 10*b*, . . . in the zigzag shape, and the plural head chips 10*a*, 10*b*, . . . act as one long liquid discharge head as a whole. For the sake of convenience, in FIG. 1, although only three head chips are shown, it is possible that the liquid discharge head 21 includes a large number of head chips 10. In the following description, the liquid discharge head 21 including a large number of head chips 10 is also referred to as multi-head.

Figure 2:
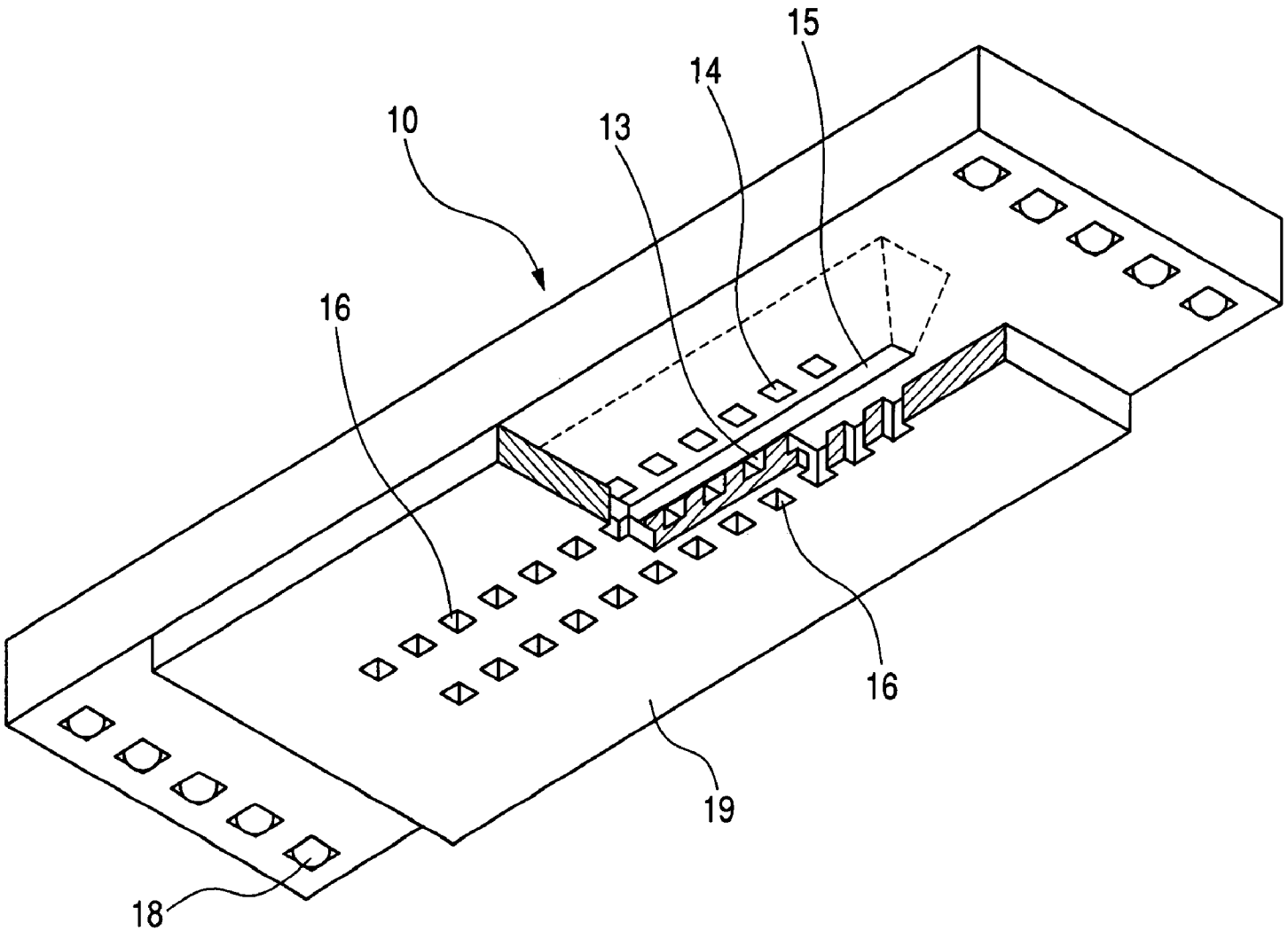
FIG. 2 is a partially cutaway perspective view showing a head chip which constitutes the liquid discharge head shown in FIG. 1.
Figure 3:
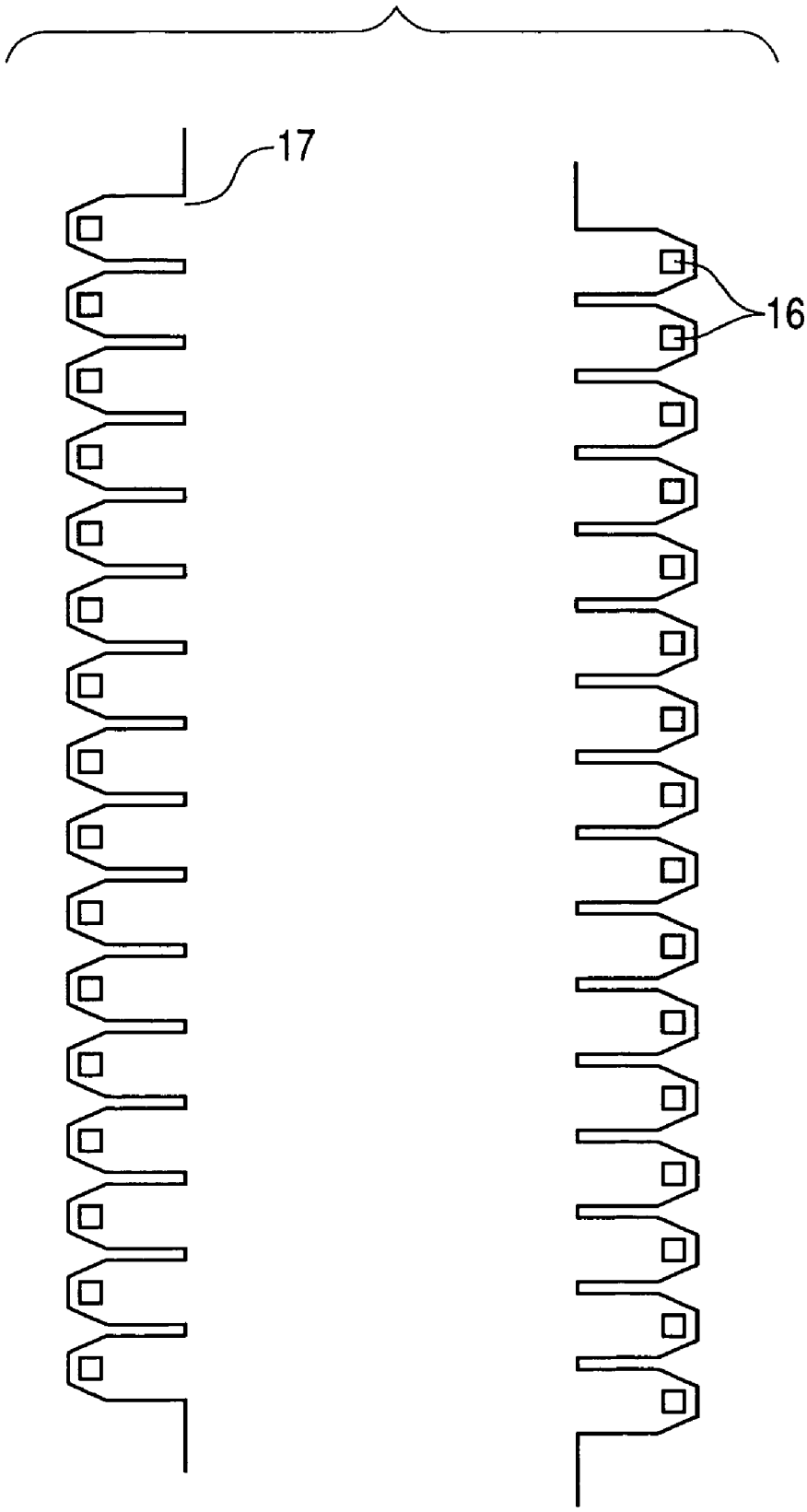
FIG. 3 is a plan view schematically showing a nozzle structure of the head chip shown in FIG. 2.

FIG. 2 is a partially cutaway showing the head chip 10 which is used for the multi-head of the first embodiment of the invention. FIG. 3 is a plan view showing a nozzle structure of the head chip 10, and FIG. 3 shows a positional relationship of a discharge port 16 and an ink flow path 17 formed by an ink chamber 13. For example, the head chip 10 is produced with an Si wafer. A long ink supply port 15 is formed, and a top plate 16 is provided on the Si wafer. The discharge ports 16 and the ink chambers 13 are formed in the top plate 19.

In each ink supply port 15, two rows of ink chambers 13 are formed so as to sandwich the ink supply port 15. The ink chambers 13 are arranged along a longitudinal direction of the ink supply port 15 at a predetermined spacing. An energy generation element 14 and the discharge port 16 are provided in each ink chamber 13. The discharge port 16 which discharges the ink is provided opposite to the energy generation element 14.

In the first embodiment, the two rows of discharge ports 16 are parallel to each other while sandwiching the ink supply port 15, and the two rows of discharge ports 16 are arranged in the so-called zigzag shape while shifting from each other by a half pitch. A spacing between the discharge ports 16 arranged along a longitudinal direction of the ink supply port 15 becomes a half of spacing between the ink chambers 13 corresponding to the discharge ports 16 in each row. The energy generation element 14 and electrode wiring (not shown) are formed on a surface of the Si wafer by a film deposition technique. The electrode wiring made of Al and the like supplies electric power to the energy generating element 14. One end of the electrode wiring is formed in a bump 18 made of Au and the like, and the bump 18 projects from the surface of a heat generating substrate.

In the first embodiment, the energy generation element 14 is not covered with the electrode wiring made of Al or the like. For example, the energy generation element 14 constitutes a part of a heat generating resistor layer made of TaN, TaSiN, Ta—Ni, and the like, and the energy generation element 14 has a predetermined sheet resistance value. The energy generation element 14 and the electrode wiring are covered with a protective layer (not shown) made of SiN having a predetermined thickness. Further, a cavitation-proof layer (not shown) made of Ta having a predetermined thickness is deposited on the surface of the protective layer located on the energy generation element 14.

The ink supply port 15 is formed by anisotropic etching utilizing crystal orientation of the Si wafer used as the heat generating substrate. In the case where the Si wafer has <100> surface and <111> crystal orientation in a direction of wafer thickness, the etching is performed up to the desired depth by using an alkali anisotropic etching solution such as KOH, tetramethylammonium hydroxide (TMAH), and hydrazine to allow the Si wafer to have selectivity in the etching direction. The ink chamber 13 and the discharge port 16 are formed by a photolithography technique. An ink droplet of 4 picoliters is discharged from the discharge port 16 by supplying the electric power to the energy generating element 14.

For the sake of convenience, in FIGS. 1 to 3, only a small number of discharge ports 16 are shown. However, each head chip 10 can have a large number of discharge ports 16.

(Liquid Discharge Recording Apparatus)

Figure 4:
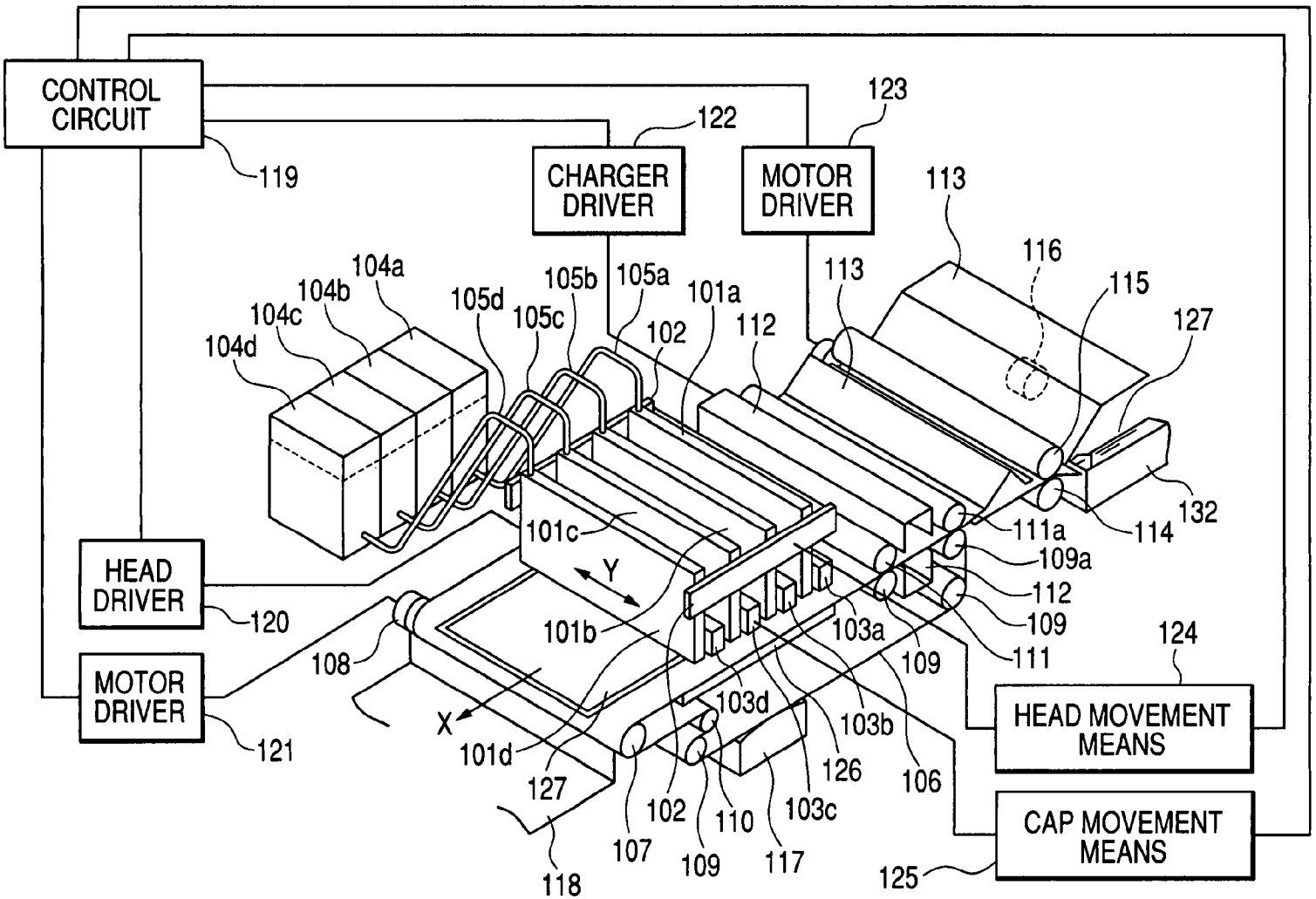
FIG. 4 is a schematic view showing a liquid discharge recording apparatus which includes the liquid discharge head shown in FIG. 1.

FIG. 4 schematically shows a liquid discharge recording apparatus (ink jet recording apparatus) according to the first embodiment to which the liquid discharge head of the invention can be applied. The liquid discharge recording apparatus is one in which the image is formed by discharging a liquid droplet from the discharge port to land the liquid droplet onto the print material while the above-described liquid discharge head is relatively moved with respect to the print material.

In FIG. 4, the reference numerals 101*a* to 101*d* denote a multi-head type of ink jet recording head (hereinafter referred to as "head") in which the long head is formed by mounting the plural heads in the zigzag shape. The heads are fixedly supported at predetermined spacings by holders 102 while placed in parallel in an arrow X direction. In the bottom surfaces of the heads 101*a* to 101*d*, the discharge ports are provided downward along an arrow Y direction, which allows the recording to be performed according to a width of the print material.

The heads 101*a* to 101*d* adopts the method of discharging a recording solution using thermal energy, and a head driver 120 controls the discharge.

A head unit includes the heads 101*a* to 101*d* and the holders 102, and the head unit is adapted to be vertically moved by head movement means 124.

Caps 103*a* to 103*d* are arranged below the heads 101*a* to 101*d* while being adjacent to the heads 101*a* to 101*d*. The caps 103*a* to 103*d* correspond to the heads 101*a* to 101*d*. An ink absorbing member such as sponge is incorporated into the caps 103*a* to 103*d* respectively.

The caps 103*a* to 103*d* are fixedly supported by a holder (not shown). A cap unit includes the holder and the caps 103*a* to 103*d*, and the cap unit is adapted to be moved in the arrow X direction by cap movement means 125.

Cyan, magenta, yellow, and black ink are supplied to the heads 101*a* to 101*d* from ink tanks 104*a* to 104*d* through ink supply tubes 105*a* to 105*d*, which enables color recording.

The ink supply utilizes capillary of the discharge port, and each liquid level of the ink tanks 104*a* to 104*d* is set lower than a discharge port position by a predetermined distance.

A belt 106 conveys a print material (recording paper) 127. The belt 106 is formed by a chargeable seamless belt.

The belt 106 is entrained about a drive roller 107, idle rollers 109 and 109*a*, and a tension roller 110 to form a predetermined path. The belt 106 is run by a belt drive motor 108. The belt drive motor 108 is coupled to the drive roller 107 and driven by a motor driver 121.

The belt 106 runs in the arrow X direction immediately below the discharge ports of the heads 101*a* to 101*d*. At this point, run-out of the belt 106 is suppressed on the lower side of the belt 106 by a fixing support member 126.

A cleaning unit 117 which removes paper dust adhering to the surface of the belt 106 is arranged at a bottom portion of the belt.

A charger 112 which charges the belt 106 is turned on or off by a charger driver 122. Electrostatic suction force generated by the charging causes the belt to suck the print material 127.

Pinch rollers 111 and 111*a* are arranged in front of and at the back of the charger 112. The pinch rollers 111 and 111*a* presses the conveyed print material against the belt 106 in cooperation with the idle rollers 109 and 109*a*.

The print material 127 in a paper-feed cassette 113 is taken out one by one by rotation of a paper-feed roller 116, and the print material 127 is conveyed to an angle guide 113 in the arrow X direction by a conveying roller 114 and a pinch roller 115. The conveying roller 114 is driven by a motor driver 123. The angle guide 113 has an angle space which permits bending of the print material 127.

The print material 127 in which the recording is ended is discharged to a paper-discharge tray 118.

A control circuit 119 controls the head driver 120, the head movement means 124, the cap movement means 125, the motor drivers 121 and 123, and the charger driver 122.

In recording action of the liquid discharge recording apparatus of the first embodiment, while the print material 127 is conveyed, the ink is selectively discharged from each liquid discharge head according to input image data. In driving each liquid discharge head, an operating position of a carriage is determined by a signal from a linear encoder, drive pulse voltage is selectively supplied to each heater at predetermined timing according to the determination of the operating position of the carriage, which allows the ink droplet discharged from each liquid discharge head to fly to adhere to the predetermined position on the print material. Therefore, the dot is formed as a recording pixel on the print material, and the image corresponding to the input image data is formed by the formed dots.

In FIG. 4, the liquid discharge head has the full line type of configuration having a length corresponding to the maximum width of the print material used for the recording, and the liquid discharge recording apparatus has the configuration in which the recording is performed to the whole print material by moving only one of the liquid discharge head or the print material. However, it is also possible that the invention is applied to the serial type of liquid discharge recording apparatus in which main scan is performed by moving the liquid discharge head and sub-scan is performed by moving the print material.

Figure 5:
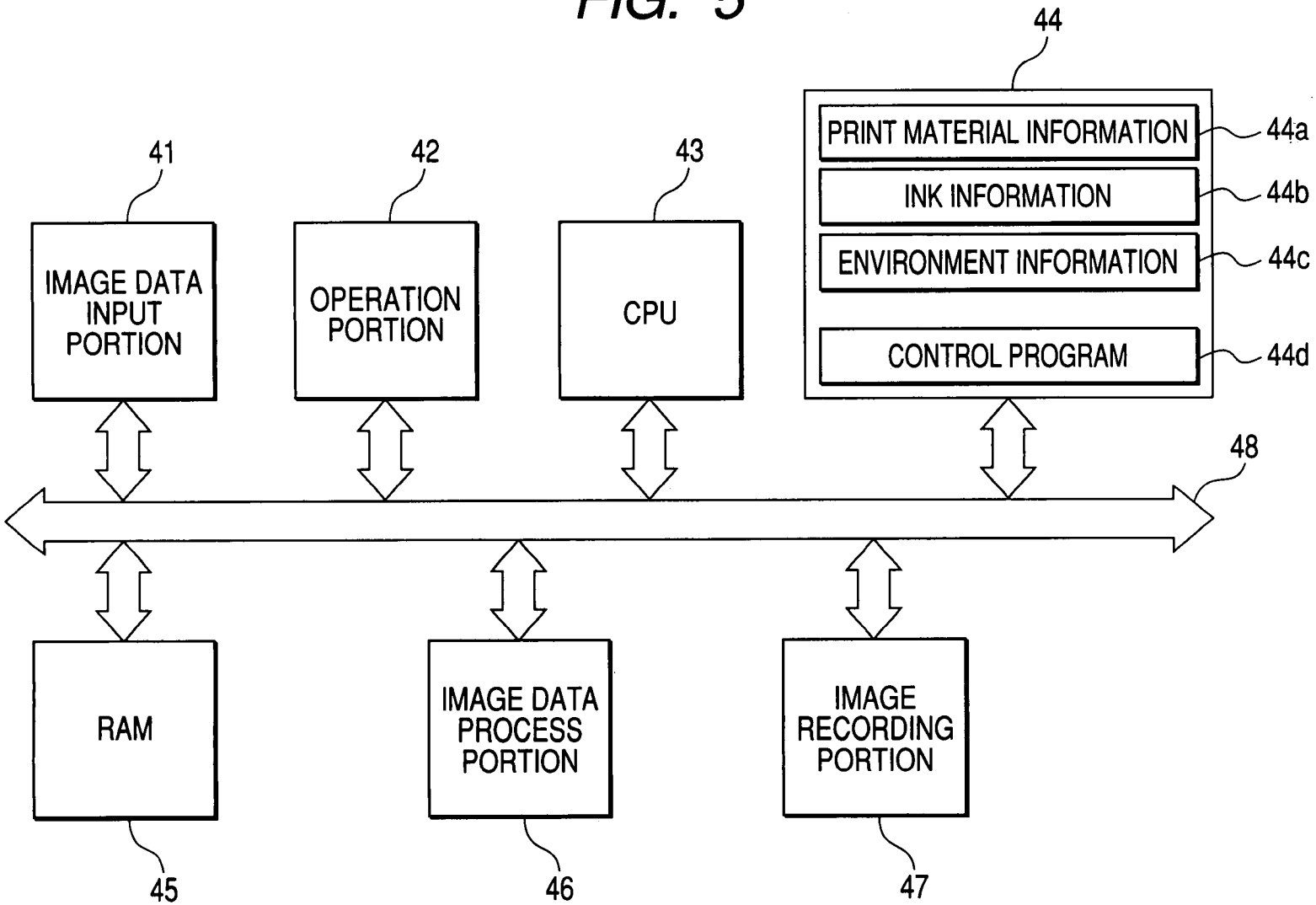
FIG. 5 is a block diagram schematically showing a control system in the liquid discharge recording apparatus shown in FIG. 4.

The liquid discharge recording apparatus has a control system which controls the above-described recording action. FIG. 5 is a block diagram schematically showing an example of the control system.

The control system includes an image data input portion 41, an operation portion 42, a CPU 43, a RAM 45, and an image data process portion 46. The image data input portion 41, the operation portion 42, the CPU 43, the RAM 45, and the image data process portion 46 are connected to one another by a bus line 48 through which an address signal, various kinds of data, a control signal, and the like are transmitted within the apparatus. Operating mechanisms and detection mechanisms such as a liquid discharge head 21, a carriage motor 30, a conveying motor 26, and a linear encoder 28 are connected to the bus line 48, and an image recording portion 47 is shown in FIG. 5 as a representative of such operating mechanisms and detection mechanisms.

The CPU 43 performs various information processes based on a control program 44*d* to control the whole of liquid discharge recording apparatus. The control program 44*d* includes a program for operating control of the portions and an error processing program. The control program 44*d* is stored in a storage medium 44 such as a ROM, an FD, a CD-ROM, an HDD, a memory card, and a magneto-optical disk, and the control program 44*d* is provided to the CPU 43 from the storage medium 44. The CPU 43 executes the control program 44*d* by reading the control program 44*d* from the storage medium 44 through the bus line 48. In some cases, the control program 44*d* is read by a reading device, the control program 44*d* is temporarily stored in a work RAM 45 which is of a temporal storage portion, and the control program 44*d* is provided to the CPU 43. It is possible that print material information 44*a* which is of the information on the kind of the print material, ink information 44*b* which is of the information on the ink used for the recording, environmental information 44*c* which is of the information on environments such as temperature and humidity during the recording action, and the like are stored in the storage medium 44 as appropriate to utilize these pieces of information for the good recording control.

The work RAM 45 is mainly used for a work area of various programs, a temporarily saving area during the error processing, the work area during the image processing, and the like. It is also possible that the work RAM 45 is used such that various tables in the storage medium 44 are copied and contents of the tables are appropriately changed to utilize the table for the image processing.

The image data input portion 41 inputs the image data to the liquid discharge recording apparatus. The image data is output from image input devices such as the scanner and a digital camera, and the image data is also stored in the hard disk drive of a personal computer and the like. The operation portion 42 includes various keys with which the user sets various parameters and performs input processes such as a recording action start direction.

The image data process portion 46 converts the image data input from the image data input portion 41 into data which can be used as a discharge pattern. The data includes binary information for indicating whether the ink dot of each color is formed at the dot position or not. The conversion can be performed by the conventional technique.

The image data input portion 41 inputs multi-level image data. The image data process portion 46 performs color separation of the multi-level image data so that the multi-level image data corresponds to each color of the ink discharged from the liquid discharge head 21. The image data process portion 46 also quantizes the multi-level image data into the image data having an N value in each color and in each pixel to produce the discharge pattern corresponding to a gray-scale value "K" in each quantized pixel. For example, when the multi-level image data expressed by 8 bits (256-level gray-scale), the gray-scale value of the output image data is converted into the value of 25 (24+1). A multi-level error diffusion technique can be used for the K-value process of the input gray-scale image data. However, the K-value process is not limited to the multi-level error diffusion technique, and any halftone process technique such as an optical density retaining technique and a dithering matrix technique can be used. The data which includes the binary information for indicating whether the dot is formed at each dot position in each color is produced by repeating the K-value process to all the pixels based on the information on the image density.

Before the description about the detail recording action in the liquid discharge recording apparatus of the first embodiment, the recording action in comparative examples to the first embodiment will be described.

FIRST COMPARATIVE EXAMPLE

Figure 6:
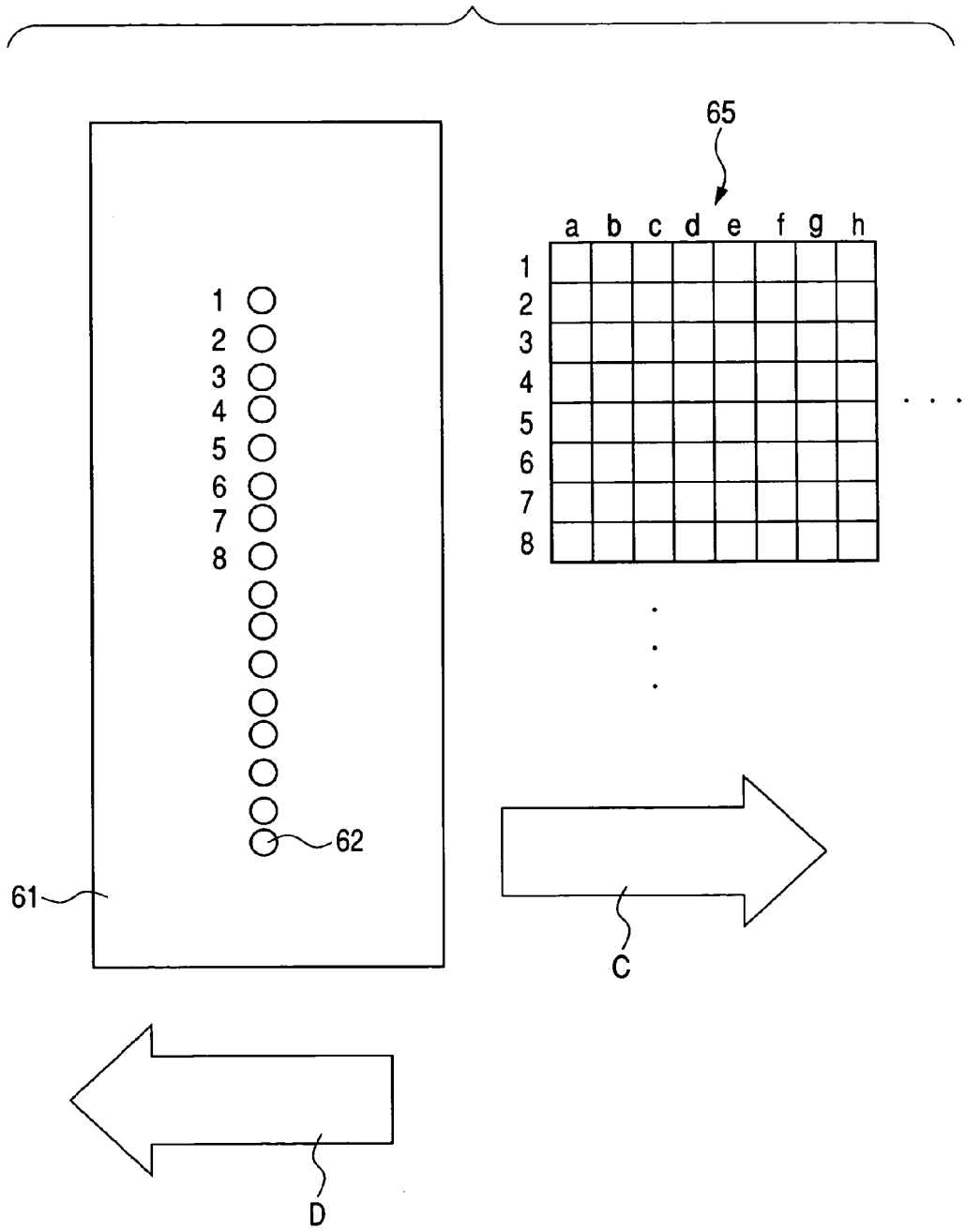
FIG. 6 is a schematic view showing a liquid discharge head of a first comparative example when viewed from the discharge port surface side, and FIG. 6 also shows a recording matrix for explaining dot positions formed with the liquid discharge head of the first comparative example.

FIG. 6 is a view explaining the recording action performed by a long liquid discharge head 61 of a first comparative example in which all discharge ports 62 are arranged in a row. In FIG. 6, an arrow C indicates the direction in which the liquid discharge head 61 is moved relative to the print material during the recording action. As shown by an arrow D, it is also possible that the print material is moved relative to the liquid discharge head 61. While the liquid discharge head 61 and the print material are relatively moved, the ink is selectively discharged from each discharge port 62 at a predetermined frequency. Therefore, the ink is caused to adhere selectively to the dot positions of a schematically shown recording matrix 65 to form the dot pattern.

The dots are formed at the dot positions of recording line No. 1 in the recording matrix 65 by discharging the ink from the discharge port 62 of No. 1, and the dots are formed at the dot positions of recording line No. 2 in the recording matrix 65 by discharging the ink from the discharge port 62 of No. 2. At this point, when the liquid discharge head 61 in which 1,280 discharge ports 62 are arranged at the pitch of 1,200 dpi (spacing of about 21.2 μm) is used, the spacing between the dot positions becomes about 21.2 μm in the recording matrix 65. When a dot size formed by the ink droplet is larger than the spacing, the adjacent dots overlap each other. When the dot size formed by the ink droplet is further larger than the spacing, the dots which are obliquely adjacent to each other also overlap each other like the dot positions (1, a) and (2, b). Even if the ink droplets do not land at the ideal positions (center of each dot positioning the recording matrix 65), it is thought that the adjacent dots also overlap each other.

Figure 7A:
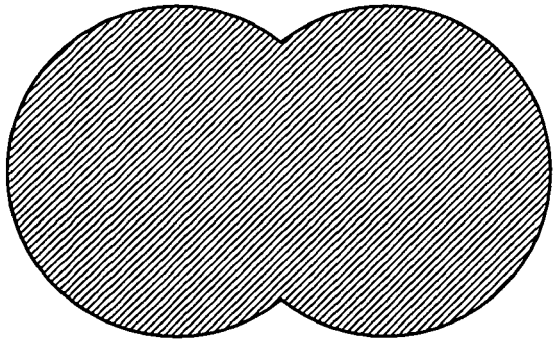
FIGS. 7A, 7B, and 7C show dot shapes when dots are formed at the dot positions adjacent to each other.
Figure 7B:
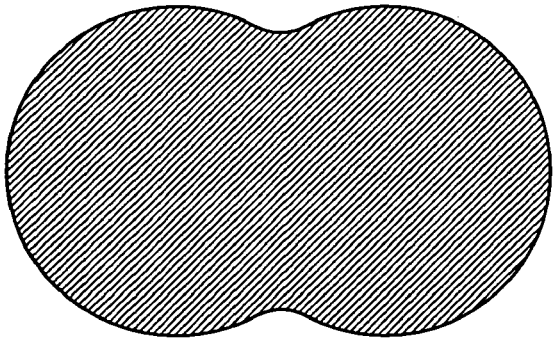
Figure 7C:
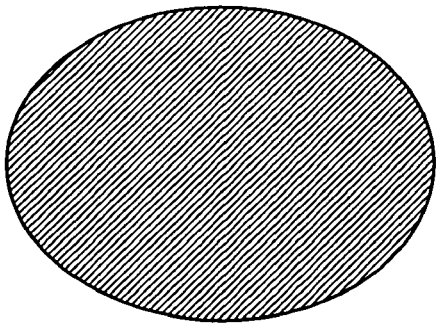

In the case where the dots overlap each other, as shown in FIG. 7A, the shape in which the adjacent dots partially overlap each other is similar to the shape separately formed by the two dots when interlace recording or multi-pass recording is performed in the conventional serial type of recording apparatus. On the other hand, when the recording is performed in one pass using the liquid discharge head of the first comparative example, the shape of the adjacent dots shifts from the ideal dot shape, such that the adjacent dots collaborate with each other to form the oval dot as shown in FIG. 7C or the dot shape is changed in the overlap portion to form the gourd-shaped dot as shown in FIG. 7B even in dots obliquely adjacent to each other.

In the interlace recording or the multi-pass recording, there is a certain time difference in ink droplets which land at the dot positions adjacent to each other. On the other hand, in the first comparative example, the land times are substantially equal to each other in the dot positions (1, a) and (2, a), and there is the difference in land time of a heater drive interval between the dot positions (1, a) and (1, b) or the dot positions (1, a) and (2, b). When a drive frequency is set to 10 kHz, the difference in land time is only 0.1 msec. Presumably this is because the shape of the adjacent dots shifts from the ideal dot shape in the first comparative example. Namely, before the ink droplet is absorbed in the print material since the ink droplet lands, the other ink droplet lands at the adjacent position, which allows the adjacent dots to be combined with each other. Therefore, it is interpreted that the desirable dot shape is lost. In other words, absorption speed of the ink droplet into the print material cannot overtake the recording speed. Accordingly, such tendencies become more remarkable, as the heater drive frequency is increased and the recording speed is increased.

Thus, in consideration of the absorption time of the ink into the print material, in forming the dots at the dot positions adjacent to each other, the inventors find it is effective to obtain the high quality image in the high-speed recording when the dots are formed at a time interval longer than the absorption time of the ink into the print material as much as possible.

Then, determination of the absorption time by measuring absorption behavior of the ink into the print material will be described in detail.

Bristow's method defined in J-TAPPI can be cited as a relatively usual measurement method for those skilled in the art. According to the Bristow's method, penetrating speed of ink into the print material within extremely short time since the ink comes into contact with the surface of the print material can be determined as an absorption speed coefficient, i.e., the time during which the ink per unit volume is absorbed into the print material in a unit area of the print material can be determined. When the times during which the ink (BCI5C: product of Canon Inc.) used in BJF850 (product of Canon Inc.) is absorbed into PROPHOTO paper (PR101: product of Canon Inc.), plain paper for ink jet and electrophotography (PBPAPER: product of Canon Inc.), and ink jet high-quality dedicated paper (HR101: product of Canon Inc.) are measured, the result shown in Table 1 is obtained.

TABLE 1

| | 10 ml/m$^2$ | 20 ml/m$^2$ |
|---|---|---|
| PR101 | 8 msec | 28 msec |
| PB Paper | 1 msec | 4 msec |
| HR101 | 1 msec | 5 msec |

At this point, because PROPHOTO paper PR101 has a structure in which an ink absorption layer is a porous type, the time during which the ink droplet is absorbed in the ink absorption layer is relatively longer. In forming the dot on PROPHOTO paper PR101 by the ink BIC5C, when the difference in land time between the ink droplets at the adjacent positions is longer than 8 msec at the amount of adhesion ink droplet of 10 ml/m$^2$, or when the difference in land time between the ink droplets at the adjacent positions is longer than 28 msec at the amount of adhesion ink droplet of 20 ml/m$^2$, the above-described deformation of the formed dots can be decreased.

SECOND COMPARATIVE EXAMPLE

Figure 8:
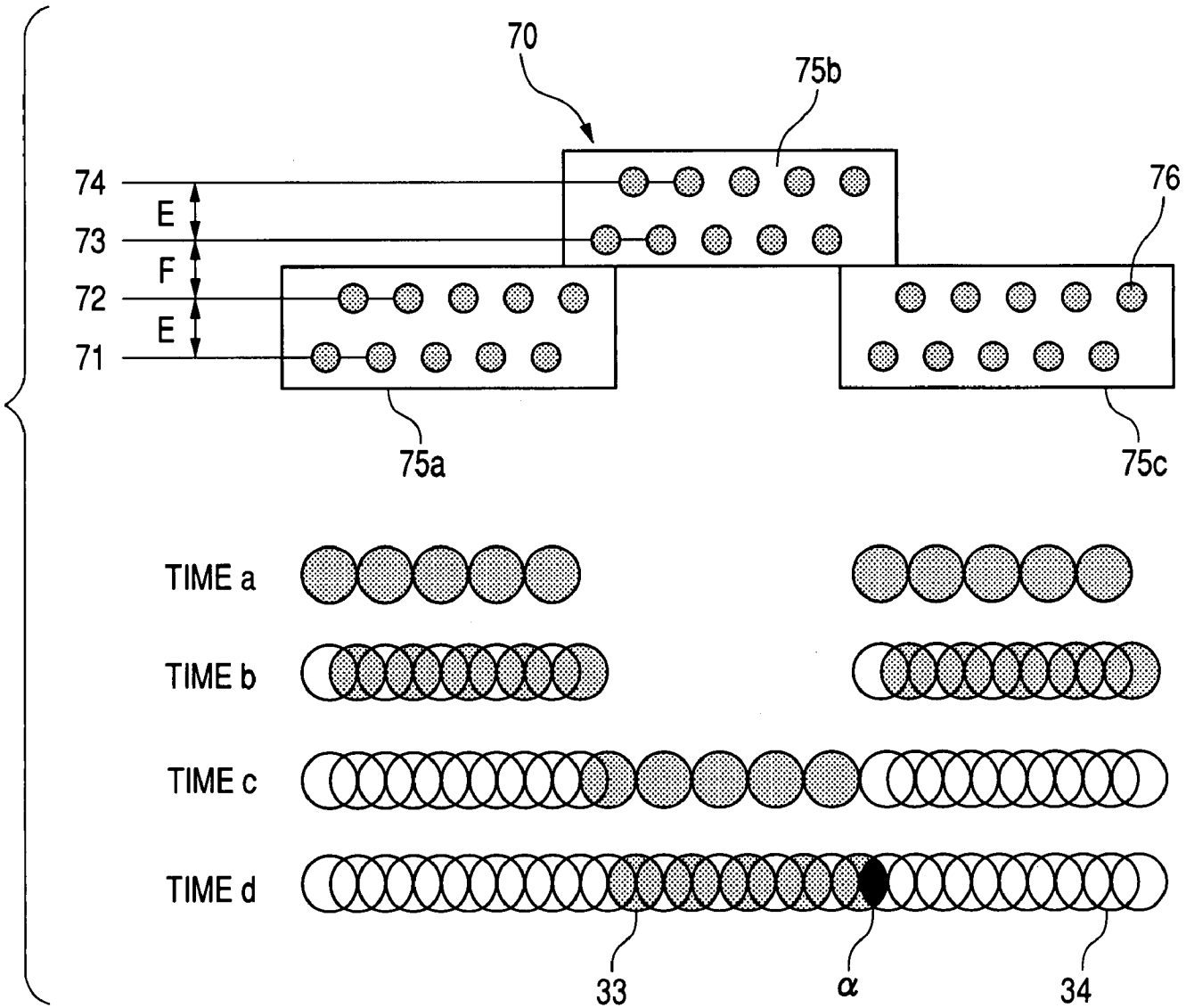
FIG. 8 is a schematic view showing a liquid discharge head of a second comparative example when viewed from the discharge port surface side, and FIG. 8 also schematically shows the dot patterns formed with the liquid discharge head of the second comparative example.

FIG. 8 shows a liquid discharge head 70 of a second comparative example.

The liquid discharge head 70 is the multi-head similar to the first embodiment, which is formed by arranging the plural head chips 75*a*, 75*b*, . . . For the sake of convenience, in FIG. 8, although only three head chips are shown, it is possible that the liquid discharge head 70 includes a large number of head chips 75.

In FIG. 8, the direction perpendicular to the discharge port row is the main scanning direction of the liquid discharge head 70 or the relatively moving direction between the liquid discharge head 70 and the print material (hereinafter referred to as main scanning direction") in the case of the used of the full line type liquid discharge head 70. The head chips are arranged in the direction orthogonal to the main scanning direction while alternately shift to one another in the main scanning direction.

In the whole liquid discharge head 70, discharge port lines 71, 72, 73, and 74 are arranged at equal spacings in parallel with the direction of the discharge port row (direction orthogonal to the main scanning direction), and the discharge port rows in each head chip are located on the discharge port lines.

The lower half of FIG. 8 shows the dot patterns in time series when the dots arranged in the direction orthogonal to the main scanning direction of the print material are formed with the liquid discharge head 70.

The dots are formed at time a by the ink droplets discharged from discharge ports 76 located on the discharge port line 71. At this point, since the pitch between discharge ports 76 in each discharge port row is the double pitch between the formed dots, the dots formed on the print material are substantially independent of one another and hardly overlap one another. Similarly, the dots are formed at time b by the ink droplets discharged from discharge ports 76 located on the discharge port line 72, the dots are formed at time c by the ink droplets discharged from discharge ports 76 located on the discharge port line 73, and the dots are formed at time d by the ink droplets discharged from discharge ports 76 located on the discharge port line 74. For the sake of convenience, in FIG. 8, the dots 33 formed at each time are shown by oblique lines, and the dots 34 formed before the times a, b, c, and d are shown by white circles.

Time intervals t between times a and b, times b and c, and times c and d are expressed by the following equation (1):

$$t=L/F \tag{1}$$

where L is the spacing between the discharge port lines (spacing between discharge port rows) and F is the recording speed, i.e., the relative speed between the liquid discharge head 70 and the print material during the main scan.

Assuming that the drive frequency of the heater in the nozzle is set to 10 kHz and the recording density in the main scanning direction (resolution of the recording matrix) is set to 1,200 dpi as well as the density of the discharge ports 76 (i.e., each dot area in the recording matrix is about 20 μm by about 20 μm), the recording speed F becomes 0.2 mm/msec. When the ink droplet having 10 ml/m$^2$ lands on PROPHOTO paper (PR101) of the print material to form the dot, since the absorption time T of the ink droplet is 8 msec as can be seen from Table 1, the time intervals t between the times a and b, the times b and c, and the times c and d can be set to the absorption time T. A distance Lpr between discharge port lines of 1.6 mm (corresponding to about 80 dots) can be obtained from the equation (1). When the ink droplet having 20 ml/m$^2$ lands on PROPHOTO paper (PR101) of the print material to form the dot, since the absorption time T of the ink droplet is 28 msec as can be seen from Table 1, the time interval t between the times a and b, the times b and c, and the times c and d can be set to the absorption time T. The distance Lpr between discharge port lines is 5.6 mm (corresponding to about 256 dots).

In the liquid discharge head 70 of the second comparative example, the spacings between the discharge port lines 71 and 72, the discharge port lines 72 and 73, and the discharge port lines 73 and 74 are set to a value close to the distance Lpr in which the dot can be formed after the ink droplets are absorbed into the print material in the adjacent dots during the recording action. Namely, a spacing E between the discharge port lines in each head chip is set to the value close to the distance Lpr. A spacing F between the discharge port lines in the adjacent head chips (for example, 75*a* and 75*b*) which shift to each other in the main scanning direction is set to the same value as the spacing E. Therefore, the oval dot or the gourd-shape dot can be prevented from forming between the dots which are adjacent to each other in the direction orthogonal to the main scanning direction while partially overlapping each other.

The value of Lpr means the spacings between the discharge port lines 71 and 72, the discharge port lines 72 and 73, and the discharge port lines 73 and 74 which are computed based on the time during which the ink is absorbed in the print material, when the ink droplets come into contact with each other in a unit area while overlapping each other. The spacing is set so that the new ink drop let from the adjacent nozzle lands on the print material after the ink droplet is absorbed. Therefore, the value of Lpr depends on the amount of ink discharged from the discharge port 76. Usually it is preferable that the total amount of discharged ink for all the colors is used for the computation of the value Lpr. However, when the different colors are sufficiently separated from one another, it is possible that the amount of discharged ink in each color unit is used for the computation of the value Lpr.

The absorption time K used for the computation of the value Lpr is determined from the Bristow's method. However, it is possible that the absorption time is determined using other measurement techniques defining the absorption time, or it is possible whether the ink is absorbed is determined by visual observation. It is also possible that the absorption time is estimated by observing the dot shapes which are formed at the dot adjacent positions while the land times are varied. Namely, when the ink droplets land on the adjacent dot positions to generate the combination of the ink droplets before the ink droplet is absorbed in the print material, the dot becomes the gourd shape as shown in FIG. 7B, or the dot becomes oval as shown in FIG. 7C. Therefore, the time during which the ink droplet is absorbed in the print material can be estimated.

According to the configuration of the second comparative example shown in FIG. 8, in the ink droplets which land at the dot positions adjacent to each other in the direction orthogonal to the main scanning direction, the dot can be prevented from combining the adjacent dots to lose the shape before the ink droplets are absorbed the print material, which allows the image quality to be improved.

However, when the image quality formed by the liquid discharge head of the second comparative example is observed in detail, the unevenness in optical density is partially generated in the direction orthogonal to the main scanning direction and the high-optical density portion is generated in a stripe shape. When the inventors investigate the stripe high-optical density portion, the inventors find that the optical density in the portion where the dots overlap each other is changed by the difference in land time between the ink droplets in the overlapping dots. The phenomenon will be described below.

Figure 9:
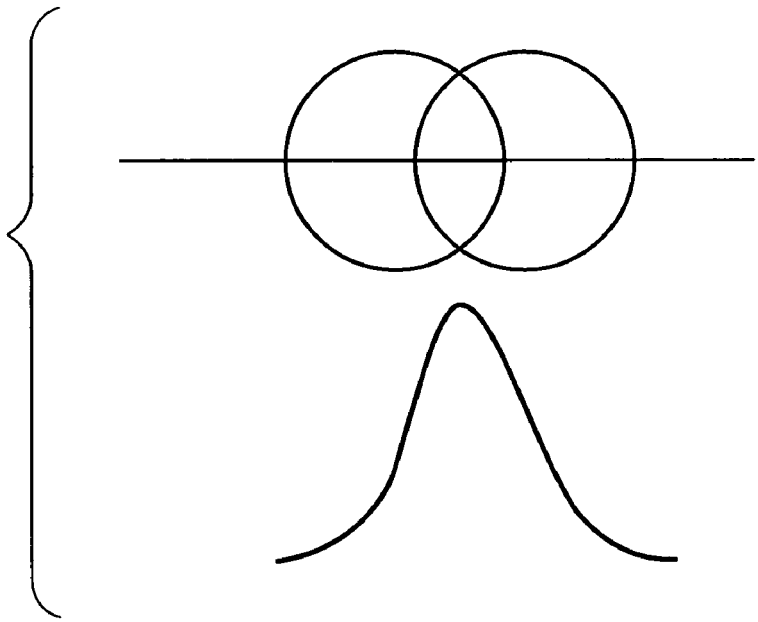
FIG. 9 shows an optical density distribution of a portion where the dots overlap each other.

FIG. 9 shows an optical density distribution of when the adjacent dots which overlap each other are formed. As can be seen from FIG. 9, the optical density has the highest value in the overlapping portion, and the optical density is gradually decreased toward the surroundings.

When a change in maximum optical density (Max. O.D.) and the difference in land time are measured, the maximum optical density is steeply changed as the difference in land time is changed up to the difference in land time of about 50 ms. The maximum optical density is kept at a certain constant value when the difference in land time is larger than about 50 ms. The results were obtained using the printer BJF850 (product of Canon Inc.), the ink BCI5C (product of Canon Inc.), and PROPHOTO paper PR101 (product of Canon Inc.). The recording was performed by changing the difference in land time, the printed dots were left for a sufficient long time, and the optical density was measured.

When the dot pattern formed by the liquid discharge head 70 of the second comparative example shown in FIG. 8 is viewed, in the adjacent dots, for example, the dot adjacent to the dot formed at the time a is formed at the time b, and the dot adjacent to the dot formed at the time b is formed at the time c. Namely, since the spacing E and the spacing F are arranged so as to be equal to each other, the difference in land time becomes equal among the time intervals between the times a and b, the time intervals between the times b and c, and the time intervals between the times c and d. However, in FIG. 8, it is seen that the difference in land time only in the portion shown by $\alpha$ differs from other portions. Namely, the portion shown by $\alpha$ is one in which the dot formed at the time a and the dot formed at the time b overlap each other. Thus, it is clear that the portion shown by $\alpha$ has the difference in land time longer than the difference in land time between the other adjacent dots. Therefore, when the high-optical density recording is performed, it is thought that the portion shown by $\alpha$ has the optical density different from the optical densities in the other portions, and thereby the portion shown by $\alpha$ is seen as the strip shape.

First Embodiment

In the configuration of the second comparative example, it is found that the stripe is generated in the formed image because the differences in land time of the overlapping dots formed on the print material adjacent to each other in the direction orthogonal to the main scanning direction differ partially.

The head in which the differences in land time of the partially overlapping dots formed adjacent to each other in the discharge port-array direction are kept constant will be described in the first embodiment.

FIG. 1 shows the liquid discharge head 21 according to the first embodiment.

The head chips 10*a*, 10*b*, 10*c*, . . . are arranged in the zigzag shape in the direction orthogonal to the main scanning direction while shifting alternately to one another in the main scanning direction (direction orthogonal to the discharge port row). The head chips 10*a*, 10*b*, 10*c*, . . . have the groups of discharge port rows 6*a*, 6*b*, 6*c*, . . . respectively. In the group of discharge port rows, two discharge port lines 5 are provided in parallel. In the discharge port row 5, the discharge ports 16 for discharging the liquid are arranged at constant spacings.

In the whole of liquid discharge head 21, there are discharge port lines 1, 2, 3, and 4 in parallel with the direction perpendicular to the main direction, the discharge port rows of the head chips are arranged so as to be located on the discharge port lines. The spacing between the adjacent discharge port rows in the same group of discharge port rows (spacing between the discharge port lines 1 and 2 and the spacing between the discharge port lines 3 and 4) is indicated by A, and the spacing between the discharge port rows adjacent to each other in the adjacent groups of discharge port rows (spacing between the discharge port lines 2 and 3) is indicated by B. The spacing A is equal to the spacing B in the first embodiment.

It is preferable that the spacings A and B are set to the value close to the distance Lpr between the ink droplets which land at the adjacent dot positions. One of the ink droplets, which lands previously on the print material, is absorbed in the print material, and then the other ink droplet lands on the print material. Accordingly, in the dots adjacent to each other in the direction orthogonal to the main scanning direction, the loss of the dot shape caused by the combination of the ink droplets can be prevented, and the image quality can be improved. In the print material whose ink absorption layer is the porous type like PROPHOTO paper PR101, the ink absorption time tends to become longer when compared with the plain paper and the high-quality dedicated paper, so that the configuration of the first embodiment is particularly effective to the use of the print material whose ink absorption layer is the porous type.

In FIG. 1, the discharge ports concerned with the recording are shown by the black dots. The discharge ports shown by white circle in the head chip are nozzles not concerned with the recording. In the first embodiment, it is possible that the nozzles which are not concerned with the recording are dummy nozzles as long as the discharge ports concerned with the recording have the above configuration. Of course, the nozzles, which are not concerned originally with the discharging, may be not formed.

The arrangement of the discharge ports concerned with the recording will be described below. In the group of discharge port rows in each head chip, the discharge ports belonging to the adjacent discharge port rows are arranged at spacings C with respect to the discharge port row direction. In the discharge port rows adjacent to each other in the adjacent groups of discharge port rows (discharge port rows 6*a* and 6*b*, and discharge port rows 6*b* and 6*c* in FIG. 1), the discharge ports belonging to the discharge port rows are arranged at the spacing C with respect to the discharge port array direction. Namely, in the liquid discharge head 21, the discharge ports contributing to the printing are arranged at the spacing C in the discharge port array direction, and the discharge ports are arranged so as not to overlap one another (not to be located at the same position) in the direction perpendicular to the discharge port row. Further, a line which connects the discharge ports located at end portions in the discharge port rows in the group of discharge port rows and the line in the adjacent groups of discharge port rows (j and k, and m and n in FIG. 1) are located on the same line.

As with the lower part of FIG. 8, the lower part of FIG. 1 shows the time-series dot patterns when the dots arrayed in the direction orthogonal to the main scanning direction of the print material are formed with the liquid discharge head 21.

As with the case shown in FIG. 8, the dots are formed at the time a by the ink droplets discharged from the discharge ports located on the discharge port line 1. Then, the dots are formed at the time b by the ink droplets discharged from the discharge ports located on the discharge port line 2, the dots are formed at the time c by the ink droplets discharged from the discharge ports located on the discharge port line 3 and the dots are formed at the time d by the ink droplets discharged from the discharge ports located on the discharge port line 4. The dots 31 formed at each time are indicated by the oblique lines, and the dots 32 formed prior to the times a, b, c, and d are indicated by the white circles.

Thus, when the dots are formed in lines in the direction orthogonal to the main scanning direction using the liquid discharge head of the first embodiment under the condition that the relative speed between the print material and the head is kept constant, as can be seen from FIG. 1, in each case, the dots adjacent to each other are formed at the same difference in land time corresponding to the time intervals between the times a and b, the times b and c, and the times c and d. Therefore, the unevenness in the optical density caused by the differences in land time at the adjacent dots can be reduced in the formed image.

As described above, in the first embodiment, the liquid discharge head 21 is formed by the plural head chips 10. Accordingly, the relatively longer liquid discharge head 21 can be formed with the relatively shorter head chips 10. At this point, the relatively shorter head chips 10 is easy to produce and manage unlike the case in which the long head having the length corresponding to the width of the print material is formed on one substrate, so that the high-performance, high-reliability head chips 10 can be produced at low production cost and high yield. Therefore, the long liquid discharge head 21 having the high performance and high reliability can be produced by forming the head 21 with the head chips 10.

Second Embodiment

Figure 10:
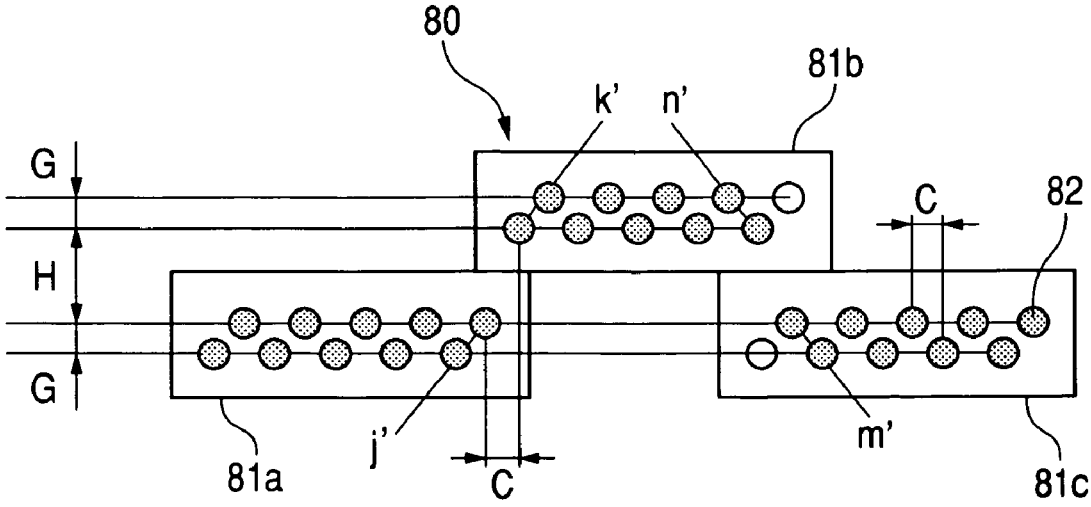
FIG. 10 is a schematic view showing the liquid discharge head used for the liquid discharge apparatus according to a second embodiment of the invention.

FIG. 10 shows a liquid discharge head according to a second embodiment. The description about the same constituent as the first embodiment is not repeated.

Similarly to the first embodiment, in a liquid discharge head 80, discharge ports 82 contributing to the printing are arranged at the spacings C in the discharge port array direction, and the discharge ports 82 are arranged so as not to overlap each other in the direction perpendicular to the discharge port row.

In the liquid discharge head 80 shown in FIG. 10, a spacing G between the discharge port rows in each head chip 81 differs from a spacing H between the discharge port rows adjacent to each other in the head chips adjacent to each other in the main direction. The line which connects the discharge ports located at end portions in the discharge port rows in the head chip and the line in the adjacent groups of discharge port rows (j' and k', and m' and n' in FIG. 10) are located on the same line.

In the case of the use of the head shown in FIG. 10, in order that the differences in land time between the dots formed adjacent to each other in the discharge port array direction while overlapping partially are kept constant, it is necessary that the relative speed between the head and the print material is adjusted according to the spacings G and H. As a result, the unevenness in optical density is decreased in the recording image and the image can be recorded with high quality.

In the first and second embodiments, the long head is formed by arranging the smaller chip heads having the group of discharge port rows in the zigzag shape. However, it is also possible to use the long chip in which the discharge ports are formed in the originally longer substrate.

(Liquid Discharge Method)

In the first embodiment, there is shown the configuration in which the liquid discharge head 21 is used. In the liquid discharge head 21 included in the liquid discharge recording system (ink jet recording system), the heater is used as the energy generating element, and flying ink droplet is formed by utilizing the thermal energy to perform the recording.

The typical configuration and principle of the liquid discharge recording system are disclosed in the specifications of U.S. Pat. Nos. 4,723,129 and 4,740,796. The liquid discharge recording system can be applied to both the so-called on-demand type head and the continuous type head. In the liquid discharge recording system, the thermal energy is generated in an electrothermal energy conversion element to generate film boiling on a heat acting surface in the recording head by applying at least one drive signal, which imparts the rapid increase in temperature exceeding nucleate boiling and corresponds to the recording information, to the electrothermal energy conversion element arranged corresponding to the sheet or liquid path in which the liquid (ink) is held. As a result, a bubble can be formed while corresponding to the drive signal one-to-one. Therefore, the liquid discharge recording system is particularly effective to the on-demand type head. The liquid (ink) is discharged through the opening for discharge by growth and shrinkage of the bubble, and at least one droplet is formed. When the drive signal is formed in a pulse shape, because the bubble is instantly appropriately grown and shrunk, discharge of the liquid (ink) which is excellent to the response can be preferably achieved. The pulse-shaped drive signals described in U.S. Pat. Nos. 4,463,359 and 4,345,262 are suitable for the liquid discharge recording system. When the conditions described in U.S. Pat. No. 4,313,124 concerning a temperature rise rate on the heat acting surface are adopted, the further excellent recording can be performed.

In addition to the configurations of the combinations of the discharge ports, the liquid paths, and the electrothermal energy conversion elements which are disclosed in the above specifications, it is possible that the liquid discharge head has the configurations disclosed in U.S. Pat. Nos. 4,558,333 and 4,459,600. In U.S. Pat. Nos. 4,558,333 and 4,459,600, the heat acting portion is arranged in a bending area.

Further, it is possible that the liquid discharge head has the configurations disclosed in Japanese Patent Application Laid-Open Nos. S59-123670 and S59-138461. The configuration in which a common slit is formed as a discharge portion of the electrothermal energy conversion element is disclosed in Japanese Patent Application Laid-Open No. S59-123670. The configuration in which an opening for absorbing a pressure wave of the thermal energy corresponds to the discharge portion is disclosed in Japanese Patent Application Laid-Open No. S59-138461.

Not only the liquid discharge head fixed to the apparatus main body but the changeable liquid discharge head in which attachment to the apparatus main body enables the electric connection to the apparatus main body and the ink supply can be used as the liquid discharge head of the embodiments. Further, it is also possible to use the cartridge type liquid discharge head in which the ink tank is integrated with the liquid discharge head.

In the bubble jet type liquid discharge head which uses the heat generating element (heater) as the energy generating element, preferably a group of many nozzles can relatively easily be realized at relatively low production cost. However, the liquid discharge head which can be used for the liquid discharge recording apparatus of the invention is not limited to the bubble jet type liquid discharge head. For example, in the case of the continuous type heads which continuously ejects the ink droplets to form particles, a charge control type head, a diversion control type head, and the like can be used for the liquid discharge recording apparatus of the invention. Further, in the case of the on-demand type head which discharge the ink droplet as needed, a pressure control type in which the ink droplet is discharged by mechanical vibration of a piezoelectric vibrating element, and the like can be used for the liquid discharge recording apparatus of the invention.

In the configuration of the liquid discharge recording apparatus of the invention, because the effect of the invention is further stabled, it is preferable that the recovery means of the liquid discharge head and other auxiliary means are added. Specifically, the capping means, cleaning means, pressurizing or suction means, pre-heat means for performing pre-heat using the electrothermal energy conversion element, another heating element, or the combination of the electrothermal energy conversion element and another heating element, and preliminary discharge means for performing the discharge aside from the recording can be cited as an example of the recovery means and other auxiliary means.

As described above, according to the invention, the groups of discharge port having the plural discharge port rows are arranged in the zigzag shape, so that the long head can be formed as a whole, and the head can respond to the high-speed recording. The differences in land time between the dots formed adjacent to each other in the discharge port array direction while overlapping partially each other are kept constant, so that the unevenness in optical density can be improved, and the high-quality image can be formed with high reliability.

This application claims priority from Japanese Patent Application No. 2004-092714 filed on Mar. 26, 2004, which is hereby incorporated by reference herein.

What is claimed is:

1. A liquid discharge head comprising:

discharge ports which discharge liquid onto a recording medium for recording on the recording medium; and a plurality of base plates (or substrates) arranged in a zigzag shape along a longitudinal direction of the base plates, each base plates having a plurality of discharge port rows having discharge ports arranged in the longitudinal direction, said plurality of discharge port rows being arranged in a direction orthogonal to the longitudinal direction, wherein said base plates comprise a first base plate, a second base plate adjacent to a side of one end portion of the first base plate, and a third base plate adjacent to a side of the other end portion, opposite to the one end portion, of the first base plate;

wherein in the direction orthogonal to the longitudinal direction, a distance between the discharge port rows in each of the first base plate, the second base plate and the third base plate is equal to a distance between the discharge port row on a second base plate side of the first base plate and the discharge port row on a first base plate side of the second base plate, and wherein regarding a first line which connects the discharge ports on a side of one end portion of the first base plate, a second line which connects the discharge ports at an end portion on the first base plate side of the second base plate, a third line which connects the discharge ports on a side of the other end portion of the first base plate, and a fourth line which connects the discharge ports at an end portion on the first base plate side of the third base plate; the first line and the second line are located on the same line, the third line and the fourth line are located on the same line, and the first line and the third line intersect with each other.

* * * * *